United States Patent [19]

Liljendahl

[11] 4,035,874

[45] July 19, 1977

[54] QUICKLY ATTACHABLE BUTTON

[76] Inventor: Sven Algot Joel Liljendahl, Gyllenstiernas vag 8, 175 76 Jarfalla, Sweden

[21] Appl. No.: 678,678

[22] Filed: Apr. 20, 1976

[30] Foreign Application Priority Data

Aug. 29, 1975 Sweden ..... 7509642

[51] Int. Cl.[2] ..... A44B 1/18; A44B 1/42

[52] U.S. Cl. ..... 24/90 E; 24/107; 24/113 MP; 24/213 R

[58] Field of Search ..... 24/90 E, 90 F, 113 MP, 24/208 A, 213 R, 216, 93, 90 PR, 107

[56] References Cited

U.S. PATENT DOCUMENTS

| | | | |
|---|---|---|---|
| 1,071,123 | 8/1913 | White | 24/110 |
| 3,141,211 | 7/1964 | Blake | 24/90 PR |
| 3,725,980 | 4/1973 | Burgio | 24/90 E |

FOREIGN PATENT DOCUMENTS

| | | | |
|---|---|---|---|
| 1,165,156 | 10/1958 | France | 24/208 A |
| 1,385,691 | 12/1964 | France | 24/90 PR |
| 2,035,735 | 7/1970 | Germany | 24/208 A |

*Primary Examiner*—Paul R. Gilliam
*Assistant Examiner*—Alex Grosz
*Attorney, Agent, or Firm*—Curtis Ailes

[57] ABSTRACT

A button having a button body including a central portion defining a button base having an uninterrupted outer wall and an inner wall with interspaces within said button base between said outer and inner walls, and an attaching means comprising a supporting plate including a plurality of pins projecting from one face of the supporting plate and having pointed heads adapted to be punched through a sheet material to which the button is to be attached, and then inserted into openings into the interspaces between said outer and inner walls, the openings being constricted to require temporary deformation of the materials of the structure as the heads of the pins are inserted into the openings.

20 Claims, 9 Drawing Figures

QUICKLY ATTACHABLE BUTTON

This invention relates to quickly attachable buttons, and particularly to buttons which are adapted for attachment to sheet material such as textile cloth for use with garments.

For some time it has been known to attach buttons to garments made from heavy cloth, such as cotton denim, without sewing the buttons on, by use of a single pin which is punched through the cloth, and the button then being secured to the end of the pin. Such buttons are typically metal, and are used for work clothes. Such buttons are typically riveted into place.

Buttons of the above description are often not very attractive, and are not well adapted for attachment to softer or thinner fabrics.

Accordingly, it is one object of the present invention to provide an improved quickly attachable button which does not require sewing for attachment, and which is well adapted for attachment to textile materials which are softer and lighter than cotton denim.

Another object of the invention is to provide an improved quickly attachable button which is very reasonable in cost and very attractive in appearance.

Other attempts have been made to produce quickly attachable buttons. For instance, U.S. Pat. No. 1,071,123—White, discloses such a button structure employing two pins carried by a plate, the pins being inserted through the textile material into a hollow button body which is then filled by a locking pin which engages the first mentioned pins to deform the first mentioned pins and prevent their withdrawal. That prior design makes the width of the base of the button adjacent to the rim of the button undesirably large. To make the structure narrow adjacent to the cloth, the pins are mounted close to one another and diverge away from one another at their ends which are assembled into the body of the button. This has a detrimental effect on the cloth as the pins are punched through the cloth in mounting the button.

Accordingly, it is another object of the present invention to provide an improved quickly attachable button which overcomes the above mentioned problems and disadvantages of prior art structures.

Further objects and advantages of the invention will be apparent from the following description and the accompanying drawings.

The invention is carried out by providing a button which is quickly attachable to sheet material such as textile cloth comprising a button body including a central portion defining a button base and having an uninterrupted outer wall and an integral inner wall with interspaces generally arranged around the axis of the button body and between said outer and inner walls, said button body including openings generally aligned parallel to the button axis from the bottom of the button body into said interspaces, an attaching means comprising a supporting plate including at least two substantially mutually parallel pins projecting from one face of said supporting plate and arranged around a center axis thereof, said pins having pointed heads adapted to be punched through said sheet material from the side of said material opposite to the side to which the button is to be attached, said pins being adapted to be then inserted into said openings into said interspaces between said outer and inner walls of said button body for attachment of said button body to said sheet material, the radially inwardly facing side of the head of each of said pins adjacent to said inner wall in the assembled position being substantially smooth, said heads of said pins each having a radial dimension as measured along a radius from the center axis of said supporting plate which is greater than the remainder of the body of the associated pin, the radial dimension of each of said interspaces between said inner and outer walls of said button body being at least as great as said radial dimension of said pin heads, said outer wall of said button body including at least one radially inwardly extending flange at said openings into said interspaces to restrict said openings to a radial dimension substantially less than said radial dimension of each of said pin heads so that the materials of the structure must be temporarily deformed to permit insertion of said pins into said axial openings.

In the accompanying drawings:

FIGS. 2 and 3 are taken at the section indicated at 2—2 in FIG. 4.

Figure 1:
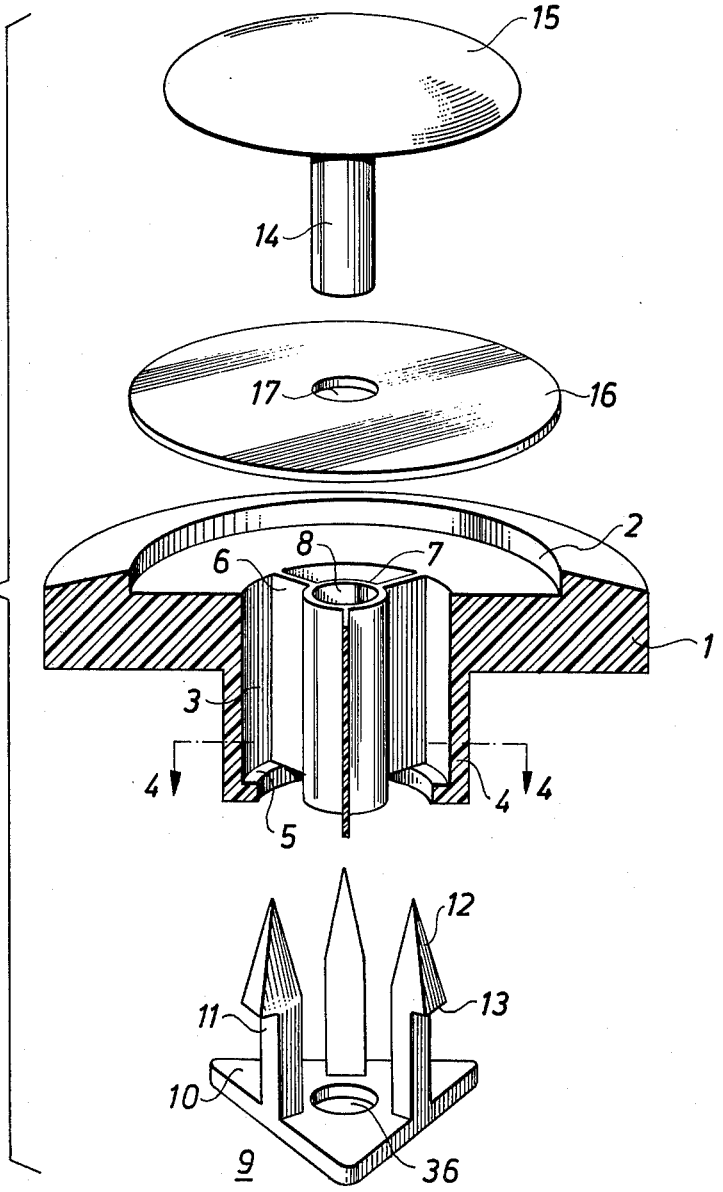
FIG. 1 is a perspective exploded view of preferred embodiment of the invention, with one of the parts shown partly in section.
Figure 9:
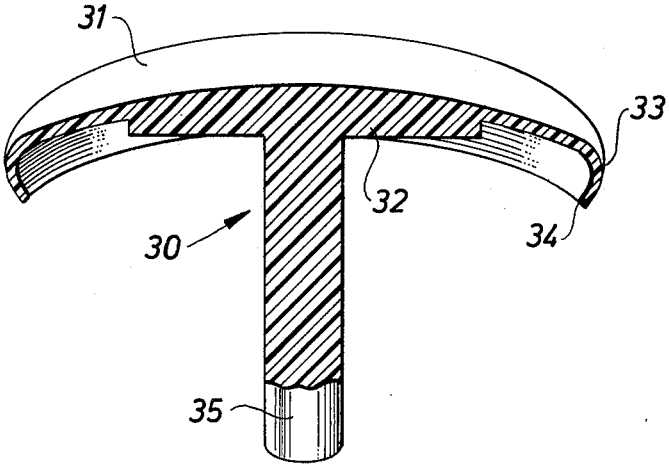

And FIG. 9 shows a modified form of the locking pin 14 which may be employed in the embodiment of FIG. 1.

Referring more particularly to FIGS. 1–5, the button is shown to include a button body 1 which may have the typical round disk shape. On the upper side of the button body there may be provided a shallow circular recess 2. The button body 1 also includes a substantially hollow central portion defining a button base and consisting of an uninterrupted outer wall 4 and an inner wall 7, with axially aligned openings 3 between the outer and inner walls. The openings 3 are often referred to hereinafter as "interspaces". The outer wall 4 is attached to the inner wall 7 by means of three radial partitions 6 which divide the axial openings into arcuate spaces. The outer wall 4 includes at the lower end a radially inwardly extending flange 5 which constricts the entrances to the axial openings. The inner wall 7 further defines an inner cavity 8 which preferably has a circular cylinder cross section.

The button also includes an attaching means 9 consisting of a supporting plate 10 having a central hole 36 with three pins extending from the upper face thereof. The pins are either fixedly mounted to plate 10, or are preferably formed integral therewith. The plate is illustrated as having a triangular shape, but may also have other shapes. The heads 12 of the pins are sharply pointed in order to be easily punched through textile material. Each of the pin heads is enlarged in relation to the remainder of the body of the pin, and is terminated at the lower edge of the pin head by a hook or barb 13. The largest transverse dimension of each pin head is the dimension measured radially outwardly along a radius from the center of the plate, corresponding to the center of the hole 36. This largest transverse dimension, referred to hereinafter as the "radial" dimension of the pin heads is substantially equal to the radially measured spacing between the inside wall 7 and the outside wall 4 of the button body. This dimension of the pin heads is substantially larger than the constricted entrances of the axial openings between the inner edge of the flange 5 and the surface of the wall 7.

The hook shaped projections 13 of the pin heads 12 are all directed radially outwards towards the outer wall 4 as the parts are assembled and cooperate with the flange 5 in securely mounting the button as more fully described below, with particular reference to FIGS. 2,3, and 4. However, the radially inwardly facing surfaces of the pin heads 12 which are adjacent to the inner wall 7 are substantially smooth, but are preferably slightly tapered, as shown in the drawing. Thus, the sharp point of each pin head is close to the geometrical axis of the pin. This provides for a minimum of permanent deformation of the textile material through which the pins are punched for attachment. As illustrated in FIG. 3, the axial length of the button body, including the base portion, between the flange 5 and the outside of the button (illustrated at the top in FIG. 3) should be at least equal to the axial length of the pin head 12. Otherwise, the points of the heads protrude above the bottom of the recess 2.

When the attaching means 9 is to be used to secure the button body 1 to a piece of cloth, the points of the heads 12 of the pins 11 are punched through the cloth. Then the pins are pushed into the axial openings between the flange 5 and the outside surface of the inner wall 7. Since the entrances to these axial openings are narrower than the radial dimensions of the heads, as explained above, the inner wall 7, or the outer wall 4, or both, must be deformed by the pin heads in order to permit insertion. This deformation is illustrated in both FIGS. 2 and 4. As soon as the heads have passed the narrowest points of the entrances to the axial openings, the flange 5 snaps under the hooks 13, as illustrated in FIG. 3, and the pin heads 12 are then retained within the axial openings between the outer wall 4 and the inner wall 7 without further substantial stress upon the materials of the structures. As shown in FIG. 3, the upward facing surfaces of the flange 5 are beveled so as to be higher towards the central axis of the button body. The underside of each of the pin head hooks 13 is beveled in a complementary manner to fit with the bevel on the flange 5. Thus, once the pin heads have snapped into the fully assembled position illustrated in FIG. 3, the pins can no longer be withdrawn from the button body without great difficulty. The assembly is thus secure and permanent.

Figure 2:
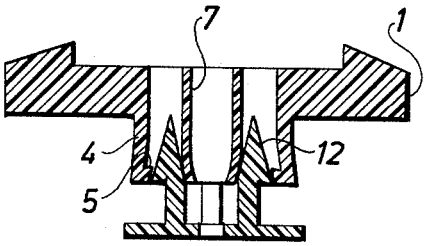
FIGS. 2 and 3 are sectional side views illustrating two different stages in the assembly of the parts of the button.
Figure 3:
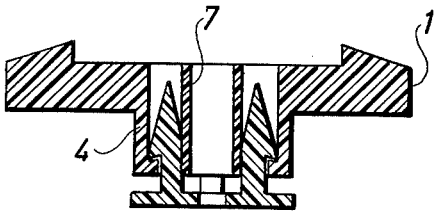
Figure 4:
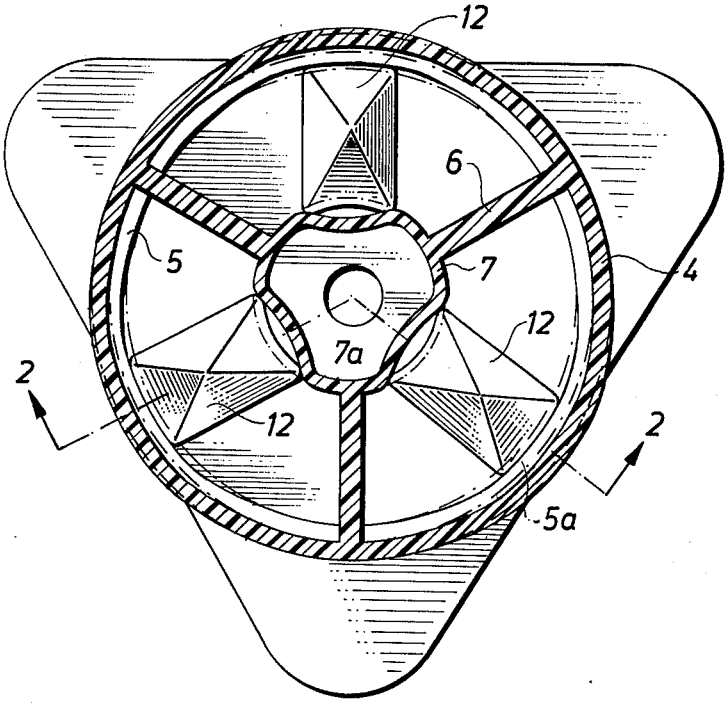
FIG. 4 is an enlarged horizontal section taken at 4–4 in FIG. 1 and illustrating the deformation of the parts of the button during the stage of assembly also illustrated in FIG. 2.

The enlarged sectional plan view of FIG. 4, taken at section 4—4 of FIG. 1, more fully illustrates the deformations which occur as the heads 12 of the pins 11 are introduced into the constricted entrances of the axial openings between the inner wall 7 and the flange 5, as also illustrated in FIG. 2. As illustrated in FIG. 4, the major deformation preferably occurs in the inner wall 7 as it is bent radially inwardly at *7a.* As also illustrated in FIG. 4, the flange 5 and the outer wall 4 are also deformed outwardly somewhat, as indicated at *5a.* The material of the inner wall 7, and its dimensions are preferably designed in relation to the material and dimensions of the outer wall so that the greatest deformation occurs in the inner wall. If the button body is formed in a single piece of uniform material, this is accomplished by simply making the inner wall 7 somewhat thinner than the outer wall 4.

The arcuate shape of the walls permits a substantially greater flexibility than if straight walls are used. The temporary deformation is carried out by temporarily increasing curvature of the walls as the heads 12 are inserted.

Figure 5:
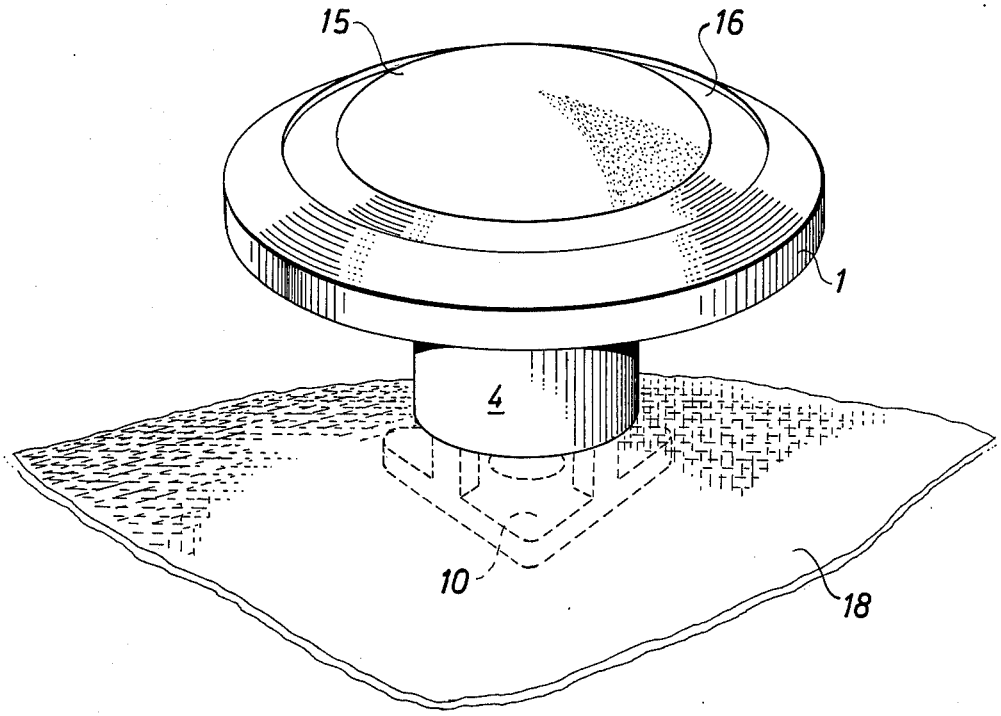
FIG. 5 is a perspective view of the button of FIGS. 1–4 in the completely assembled and mounted state.

The assembly and attachment of the parts of the button structure in the condition as shown in FIG. 3 is permanent and secure. Thus, disassembly and detachment is difficult. However, it is preferred, in accordance with the invention, to provide a locking pin to fill the cavity 8 within the inner wall 7 to prevent the deformation of the inner wall 7 which would be required to successfully detach the pin heads from the button body 1, thus making the attachment even more secure. A suitable locking pin 14 is illustrated in FIG. 1. The locking pin 14 is preferably provided on its upper end with a head 15 which has a diameter smaller than the recess 2 in the button body 1 so that it will fit into that recess. The upper outer side of the locking pin head 15 may carry a decoration consisting of a decorative pattern, a monogram, or an insignia, which is appropriate if the button is used for a uniform. If desired, the diameter of the head 15 can be made less than the diameter of the recess 2, and a special decorative plate or washer 16 having a central hole 17 and a diameter fitting into the recess 2 can be threaded onto the locking pin 14 so that the assembled button appears as indicated in FIG. 5. In FIG. 5, the attaching means plate 10 is indicated in dotted outline beneath the cloth 18 to which the button is attached. The bottom edge of the outer wall 4 bears against the upper side of the cloth 18. The decorative washer 16 is held in position by the locking pin head 15.

The body 1 of the button, and the mounting means 9 of the button are preferably each composed of a one piece synthetic resin casting, or injection molded part. Various commonly used synthetic resin materials may be employed for this purpose. These materials are generally referred to hereinafter simply as "plastics". Because of the stresses applied to the critical attachment parts of the assembly, including the heads 12 of the pins 11, and the flange 5 of the outer wall 4, these parts are preferably composed of a reinforced plastic material. The reinforcement may be carried out by incorporating strong fiber fillers within the plastic.

The locking pin 14 normally has a snug fit within the cavity 8 so that, once inserted, it is retained in the assembled position. However, if it is desired to change the appearance of the button, the locking pin, with its decorative head 15 may be pushed out by the use of a drive pin inserted from below through the hole 36 and the cavity 8. Thus, both the locking pin and the decorative washer 16, if any, can be removed, and a new or different decorative washer 16, and a new locking pin 14 having a different design upon the head 15 may be substituted.

Figure 6:
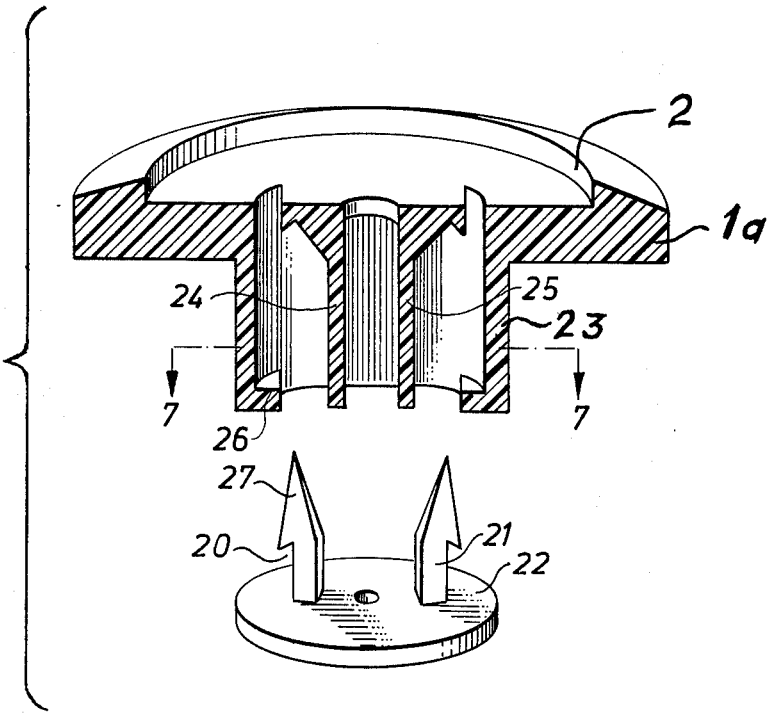
FIG. 6 is a perspective exploded view of the two essential parts of a modified embodiment of the invention.
Figure 7:
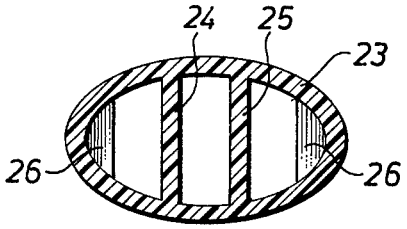
FIG. 7 is a horizontal section of the embodiment of FIG. 6 taken at section 7—7.
Figure 8:
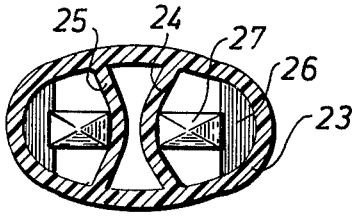
FIG. 8 is another horizontal section taken at 7—7 in FIG. 6 and illustrating the deformation of the parts during the assembly step.

FIGS. 6–8 illustrate an alternative embodiment of the invention which is especially suited for smaller buttons for garments such as shirts. This embodiment employs only two pins 20 and 21 on a plate 22 which may be circular, as illustrated, or oval, or any other convenient shape such as rectangular. In this embodiment, the outer wall 23 of the base portion of the button body 1a has an elliptical cross section, as illustrated in the sectional plan view of FIG. 7. The inner wall defining the axial openings for the pins 20 and 21 and also defining the central cavity, is formed by two partitions 24 and 25 which extend between opposite inside surfaces of the outer wall 23 and generally perpendicularly to the long axis of the ellipse. They extend on opposite sides of the central axis of the button. The structure of the radially inwardly extending flange at the bottom edge of the outer wall 23 consists of two separate radially inwardly extending flanges 26, the inner edges of which are generally parallel with the partitions 24 and 25 and spaced from those partitions by a dimension corresponding generally to the radial dimension of each of the pins 20 and 21 beneath the heads 27 of the pins. The heads 27 of the pins generally conform with the heads 12 of the pins of the embodiment of FIGS. 1–5, and other details of the structure generally conform with that embodiment.

When the heads 27 of the pins 20 and 21 are forced to pass through the apertures between the flanges 26 and the partitions 24 and 25, the partitions (inner walls) must yield, as illustrated in FIG. 8. The outer wall 23 is also deformed temporarily, to a lesser extent, as illustrated, so that the outer wall is somewhat expanded along its long axis, and shortened somewhat along its short axis.

While not illustrated in the drawings, a locking pin structure is also preferably provided for the embodiment of FIGS. 6–8, which is similar to the locking pin 14 of the previously described embodiment, except that the locking pin for the embodiment of FIGS. 6–8 preferably has the substantially rectangular shape required to completely fill the cavity between the partitions 24 and 25. This embodiment may also include a decorative washer similar to washer 16 of the embodiment of FIGS. 1–5 except that the central opening must be modified to accommodate the differently shaped locking pin.

FIG. 9 illustrates an alternative locking pin arrangement which may be employed with the embodiment of FIGS. 1–5 in place of the locking pin 14. In this modification, the locking pin 30 has a head 31 with a thicker portion 32 fitting into the recess 2, and a thinner cup-shaped portion 33 encircling the outer periphery of the button body, and having a flange 34 bent downwardly and somewhat inwardly. The opening defined by the lower edge of the flange 34 is somehwat narrower than the outer diameter of the button body 1 so that when the locking pin is introduced into the cavity 8, the flange 34 can be forced past the outer rim of the button while being expanded, and then snapped in under the edge of the periphery of the button. Thus, the locking pin is more securely and permanently retained on the button. Since the locking pin head 31 completely covers the outer face of the button, it can be provided with any desired decoration, and completely determines the appearance of the button. Furthermore, by changing this locking pin, and substituting a different locking pin having a different decoration, the button can be completely changed in appearance. As an alternative construction, the thicker portion 32 of the head of the pin which fits into the recess 2 in the body may be omitted, and the thickness of the head 31 selected in another way. For instance, the recess 2 may be omitted.

One of the advantages of the invention is that, with any of the embodiments, the garment may be manufactured, including attachment of the buttons and then the final appearance of the buttons may be determined at a much later time by selecting locking pins and decorative plates which have the desired decoration or insignia. For instance, military uniforms may be manufactured in a standard way without insignia, and then locking pins having the correct insignia for different branches of the armed services may be mounted when it is determined which branch the uniforms will be used for.

The plate 10 of FIG. 1 carrying pins 11, and the plate 22 of FIG. 6 carrying pins 20, 21 may have rounded edges, and the underside may be smooth and convex.

One important advantage of the embodiment of FIGS. 1–5 is that with the greater number of pins, the stress imposed on the cloth is less and the button may be successfully attached and maintained upon softer and lighter weight cloth. While only three pins are illustrated in the embodiment of FIG. 1, it will be understood that a larger number of pins may be employed, if desired, thus further distributing the stress on the cloth.

The plastic material preferred for the structure of the button of this invention has a number of advantages. For instance, the elasticity of the material prevents damage during ironing, particularly if the garment is ironed in a large ironing machine, sometimes referred to as a mangle.

The plastic material also permits the selection of any one of a number of different colors and appearances. For instance, a metallized filler may be used in the plastic, so as to give the button a metallic appearance which is commonly desired, especially for military uniforms.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. A button which is quickly attachable to sheet material such as textile cloth comprising a button body including a central portion defining a button base and having an uninterrupted outer wall and an integral inner wall with interspaces generally arranged around the axis of the button body and between said outer and inner walls, said button body including openings generally aligned parallel to the button axis from the bottom of the button body into said interspaces, an attaching means comprising a supporting plate including at least two substantially mutually parallel pins projecting from one face of said supporting plate and arranged around a center axis thereof, said pins having pointed heads adapted to be punched through said sheet material from the side of said material opposite to the side to which the button is to be attached, said pins being adapted to be then inserted into said openings into said interspaces between said outer and inner walls of said button body for attachment of said button body to said sheet material, the radially inwardly facing side of the head of each of said pins adjacent to said inner wall in the assembled position being substantially smooth, said heads of said pins each having a radial dimension as measured along a radius from the center axis of said supporting plate which is greater than the remainder of the body of the associated pin, the radial dimension of each of said interspaces between said inner and outer walls of said button body being at least as great as said radial dimension of said pin heads, said outer wall of said button body including at least one radially inwardly extending flange at said openings into said interspaces to restrict said openings to a radial dimension substantially less than said radial dimension of each of said pin heads so that the materials of the structure must be temporarily deformed to permit insertion of said pins into said axial openings.

2. A button as claimed in claim 1 wherein at least the heads of said pins consist essentially of reinforced plastic.

3. A button as claimed in claim 1 wherein at least the radially inwardly extending flange portions of said outer walls consist essentially of reinforced plastic.

4. A button as claimed in claim 1 wherein each of said pin heads includes a hook shaped projection extending radially outwardly towards said outer wall of said button body in the assembled position and adapted to cooperate with the adjacent radially inwardly extending flange for securing each pin within said button body portion.

5. A button as claimed in claim 1 wherein the axial length of said button body from the inside surface of said flange to the outer face of the button body is at least equal to the length of each pin head measured along the pin axis.

6. A button as claimed in claim 1 wherein said supporting plate includes a central opening therein.

7. A button as claimed in claim 1 wherein said outer wall of said button body is cylindrical, and wherein said inner wall defines a hollow inner cavity, the material of said inner wall being more yielding than that of said outer wall to permit elastic deformation thereof for insertion of said pin heads past said radially inwardly extending flanges of said outer wall.

8. A button as claimed in claim 7 wherein the material of said inner wall is made to be more yielding by providing a reduced thickness of said inner wall.

9. A button as claimed in claim 7 wherein said outer wall of said button body defines a non-circular cylinder having a substantially elliptical cross section.

10. A button as claimed in claim 9, wherein said inner wall comprises two partitions bridging across between opposite inside surfaces of said outer wall substantially perpendicular to the long axis of the ellipse and on opposite sides of the central aixs of the button body.

11. A button as claimed in claim wherein there is provided a locking pin for insertion into said inner cavity to substantially completely fill said cavity.

12. A button as claimed in claim 11 wherein said cavity is a circular cylinder and said locking pin is circular in cross section and has a substantially uniform diameter throughout the length thereof exclusive of the head.

13. A button as claimed in claim 12 wherein said outer wall of said button body defines a circular cylinder.

14. A button as claimed in claim 13 wherein there are provided at least three of said pins projecting from said supporting plate.

15. A button as claimed in claim 13 including radial partitions extending between said outer wall and said inner wall to further define said axially aligned openings between said outer and inner walls.

16. A button as claimed in claim 11 wherein said hollow inner cavity is open through the outer face of said button body and wherein said locking pin includes a head at the outer end thereof adapted to overlay at least a portion of said outer face of said button body.

17. A button as claimed in claim 16 wherein said locking pin head includes a decorative outer face.

18. A button as claimed in claim 16 wherein there is provided a decorative washer having a central perforation through which the locking pin is threaded as it is assembled to the body of the button for retention upon the button body beneath the head of said locking pin.

19. A button as claimed in claim 11 wherein said locking pin includes a cup-shaped head at the outer end thereof surrounding the outer periphery of said button body.

20. A button as claimed in claim 19 wherein the outermost rim of said cup-shaped head includes a flange adapted to snap beneath the outer edge of the button body in the assembled position.

* * * * *

UNITED STATES PATENT AND TRADEMARK OFFICE

CERTIFICATE OF CORRECTION

PATENT NO. : 4,035,874

DATED : July 19, 1977

INVENTOR(S) : SVEN A. J. LILJENDAHL

It is certified that error appears in the above-identified patent and that said Letters Patent are hereby corrected as shown below:

Column 2, line 18, --a-- should be inserted before "preferred"

Column 5, line 46, "somehwat" should read --somewhat--
line 66, the comma has been omitted after "buttons", Column 8, line 7, after "claim" --7-- should be inserted.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*